US005551249A

United States Patent [19]

Van Steenburgh, Jr.

[11] Patent Number: 5,551,249

[45] Date of Patent: Sep. 3, 1996

[54] LIQUID CHILLER WITH BYPASS VALVES

[76] Inventor: Leon R. Van Steenburgh, Jr., 850 E. La. Devils Gulch Rte., Estes Park, Colo. 80517

[21] Appl. No.: 956,749

[22] Filed: Oct. 5, 1992

[51] Int. Cl.[6] ..... F25B 41/06

[52] U.S. Cl. ..... 62/196.4; 62/197; 62/201; 62/205; 62/223

[58] Field of Search ..... 62/201, 197, 196.4, 62/205, 211, 223, DIG. 17

[56] References Cited

U.S. PATENT DOCUMENTS

| | | | |
|---|---|---|---|
| 4,517,811 | 5/1985 | Atsumo et al. | 62/197 |
| 4,535,603 | 8/1985 | Willitts et al. | 62/196.4 |
| 4,689,969 | 9/1987 | Van Steenburgh, Jr. | 62/474 |
| 4,711,094 | 12/1987 | Ares et al. | 62/196.4 X |
| 4,718,245 | 1/1988 | Van Steenburgh, Jr. | 62/196.4 |
| 4,815,298 | 3/1989 | Van Steenburgh, Jr. | 62/196.4 |
| 4,918,931 | 4/1990 | Lowes | 62/197 X |

FOREIGN PATENT DOCUMENTS

| | | | |
|---|---|---|---|
| 0156253 | 10/1979 | Japan | 62/201 |

*Primary Examiner*—Harry B. Tanner
*Attorney, Agent, or Firm*—Beaton & Swanson, P.C.

[57] ABSTRACT

A liquid chiller refrigeration system with two bypass valves (a condenser bypass valve and a vapor bypass valve), a chiller control valve downstream from the vapor bypass valve, and a remote condenser in addition to a primary heat reclaim condenser so that the recovered heat may be directed to alternate locations. The condenser bypass valve facilitates rapid system start up in low ambient temperature; the vapor bypass valve and chiller control valve facilitate steady performance under varying load conditions; and the remote condenser and heat reclaim condenser provide a choice of discharging the heat to a remote location (typically, outdoors), or to the immediate surroundings of the refrigeration system.

9 Claims, 3 Drawing Sheets

LIQUID CHILLER WITH BYPASS VALVES

FIELD OF THE INVENTION

This invention relates to refrigeration systems having bypass valves (a condenser bypass valve and a vapor bypass valve), a chiller control valve downstream from the vapor bypass valve, and a remote condenser in addition to a primary heat reclaim condenser so that the recovered heat may be directed to alternate locations. The condenser bypass valve facilitates rapid system start up in low ambient temperature; the vapor bypass valve facilitates steady performance under varying load conditions; and the remote condenser and heat reclaim condenser provide a choice of discharging the heat to a remote location (typically, outdoors), or to the immediate surroundings of the refrigeration system.

The invention has particular utility for cooling and controlling the temperature of a liquid, and may be used as the liquid chiller in such applications as electronic component production, photochemicals, plating, plastics, high speed drilling, machine tools, reclamation of volatile degreasing solvents, laser and x-ray cooling and other temperature sensitive operations.

BACKGROUND OF THE INVENTION

For precision cooling of a liquid for temperature sensitive operations, it would be highly desirable to achieve a rapid system start up from low ambient temperature, to keep the chilled liquid temperature nearly constant over varying load conditions, and to be able to control the discharge of system heat. Because ambient temperatures may be low am start up, and may vary during the operation of the liquid chiller, an effective liquid chiller must be able to compensate. To attain these desirable characteristics, an effective liquid chiller must respond to changing heat/temperature/pressure conditions within the system, as those conditions may be influenced by the ambient conditions surrounding the system.

Refrigeration systems for chilling a liquid are generally old and well-known in the art. Such systems of the vapor compression type conventionally include a compressor, a condenser, an expansion device, and an evaporator, with a refrigerant circulating repeatedly through the system.

In the evaporator, the refrigerant boils (evaporates) at a temperature sufficiently low to absorb heat from a space or from a medium that is being cooled. The evaporating temperature is determined, for any given refrigerant, by the pressure maintained in the evaporator—the higher the pressure, the higher the boiling point; the lower the pressure, the lower the boiling point.

The compressor pulls and removes vapor from the evaporator as the vapor is formed, at a rate sufficiently rapid to maintain the desired pressure in the evaporator. The vapor is then compressed and delivered to the condenser.

The condenser dissipates heat contained in the hot vaporized refrigerant to a circulating coolant, usually ambient air, although water or brine could be used as well. The refrigerant is condensed to a liquid and is ready for circulation, through an expansion device, back to the evaporator.

Between the condenser and the evaporator is a flow restriction device or an expansion device such as a valve. The expansion device sharply reduces the pressure of the liquid refrigerant passing through it, thereby reducing the pressure and temperature of the refrigerant until they reach the evaporator pressure and temperature, or, put another way, until they reach the level maintained by the suction line of the compressor as it pulls vapor from the evaporator.

The vapor compression and expansion refrigeration process just described depends upon a refrigerant which absorbs heat at a relatively low temperature (in the evaporator), and then, under the action of mechanical work (in the compressor) is compressed and raised to a sufficiently high temperature to permit the dissipation of this heat to the surrounding ambient (in the condenser). Accordingly, the system uses the refrigerant as a heat pump fluid that absorbs heat from a space or medium that is to be cooled, and dumps the recovered heat in another location.

The absorption of heat, and the cooling effect of the system, is produced in the evaporator as the vaporizing refrigerant absorbs heat, thereby cooling its surroundings. The evaporator may cool in a direct method, where the refrigerant acts in direct heat exchange to cool a space or a product; or it may cool by an indirect method, where the refrigerant is in heat exchange with a secondary medium such as water or brine, which is cooled by the refrigerant and then pumped to a more distant point to absorb heat.

The evaporator heat exchange structure may comprise a fin and tube construction for cooling air, or it may comprise a shell and tube construction for cooling a liquid. The shell and tube structure includes a set of tubes surrounded by a shell. The boiling (evaporating) refrigerant is carried inside the tubes, and the liquid to be cooled surrounds the tubes within the shell. The evaporating refrigerant is thereby circulated in heat exchange relation with the liquid within the surrounding shell. Because the evaporation of the liquid refrigerant is an endothermic reaction, the evaporating refrigerant will absorb heat from its surroundings. In the fin and tube evaporator structure the refrigerant removes heat from the air. In the shell and tube evaporator structure the evaporating refrigerant removes heat from the liquid to be chilled.

In the condenser, heat must be removed from the hot refrigerant vapor discharged into the condenser from the compressor, and the vapor must be condensed to a liquid. Because the condensation of a gas is an exothermic reaction, the condensing vapor will give off heat to its surroundings. As a result, the condenser dissipates heat from the refrigerant to a surrounding coolant, either to the ambient atmosphere (using a fin and tube structure) or to a circulating liquid (using a shell and tube structure). The temperature of the refrigerant vapor in the condenser is kept above that of the coolant by compression to ensure that heat is transferred to the coolant.

The expansion valve feeds the evaporator with a controlled flow of liquid refrigerant from the condenser. The controlled flow must allow a sufficient amount of refrigerant into the evaporator for the cooling load, but not in such excess that unevaporated liquid refrigerant passes into the compressor (which would damage the compressor). The flow rate of refrigerant from the condenser to the evaporator through the expansion device may be modulated by a temperature-controlled valve located between the condenser and the evaporator, near the evaporator inlet. Such a device is commonly known as a thermal expansion valve.

The thermal expansion valve is a diaphragm-operated valve with opposing pressures above and below the diaphragm causing the diaphragm to open and close an attached valve stem and seat. A pressure dome and cylinder within the valve defines a chamber above and a chamber below the diaphragm.

The pressure above the diaphragm is related to the temperature of the refrigerant leaving the evaporator. Above the diaphragm is a dome connected to a temperature sensing bulb through a capillary tube. The bulb, dome and capillary tube are filled with a refrigerant vapor and/or liquid that has similar pressure/temperature characteristics as the refrigerant in the system involved. The temperature sensing bulb is located at the outlet of the evaporator. Below the diaphragm is a connection to the evaporator inlet so that the pressure on the underside of the diaphragm is the pressure in the evaporator. A spring under the diaphragm or valve stem causes a bias towards the valve closed position.

As the temperature of the refrigerant vapor leaving the evaporator increases, the temperature of the expansion valve bulb increases. The increasing temperature of the bulb expands the fluid in the capillary tube. This increases the pressure above the diaphragm, urging the diaphragm against the bias spring and causing the expansion valve to move towards the open position, thereby passing more liquid refrigerant into the evaporator. The high temperature at the evaporator outlet ensures that vaporized refrigerant is being drawn into the compressor while liquid/vaporized refrigerant is flowing through the thermal expansion valve and into the evaporator at a controlled (relatively open) flow rate.

Conversely, as the temperature of the refrigerant at the evaporator outlet decreases, the temperature of the expansion valve bulb decreases. The decreasing temperature of the bulb decreases the pressure on the top of the diaphragm and allows the bias spring to close the valve, thus restricting the refrigerant flow into the evaporator. The decreasing temperature at the evaporator outlet warns that the possibility of passing liquid refrigerant to the compressor is increasing. The lessened refrigerant flow into the evaporator allows the evaporator to continue to vaporize all of the refrigerant and ensures that only vaporized refrigerant is being drawn into the compressor because of a controlled (relatively restricted) flow rate through the thermal expansion valve and into the evaporator.

Given the foregoing system components and process requirements, the pressure in the evaporator is determined by the process temperature which is to be maintained. The pressure in the condenser is determined by the temperature of the available cooling medium (circulating water or ambient air temperature). The refrigerant is a gas having a high critical temperature. Among the refrigerants in common use in systems such as the one described are the halogenated hydrocarbons: refrigerant-12 is dichlorodifluoromethane ($CCl_2F_2$), known under the brand name, FREON-12. Refrigerant-22 is monochlorodifluoromethane ($CClHF_2$). Refrigerant-22 operates at a higher pressure than FREON-12 and, in general, is used in higher temperature applications.

The foregoing discussion of a typical refrigerant vapor compression cycle included a system having a compressor, a condenser, an expansion valve, and an evaporator. A receiver is often added, and may be located after the condenser and before the expansion device.

The receiver is a storage tank, having an approximate volume capacity corresponding to that of both the evaporator and the condenser. The receiver acts as a reservoir for the refrigerant. During periods of low condenser ambient temperature, it is necessary to flood the condenser with liquid to reduce its capacity and maintain a desirable condensing pressure/temperature. Therefore, a reservoir must be provided in the system to accommodate the excess refrigerant during normal ambient temperatures.

Accordingly, a more complete refrigeration system for chilling a liquid may include a compressor, condenser, receiver, thermal expansion valve, and an evaporator. Although such systems are well known in the art, present systems do not generally start up quickly under low ambient temperature conditions, do not generally respond well under varying load conditions, and do not generally provide for effective use of the recovered heat.

In many applications, the difficulties of rapid start up under low ambient and steady performance under varying load are of relatively little concern. But, when the cooled liquid is used for precision cooling in such temperature-critical applications as electronic component production, photochemicals, plating, plastics, high speed drilling, machine tools, reclamation of volatile degreasing solvents, laser and x-ray cooling, these difficulties become a greater concern.

One way of addressing these concerns is by way of bypass valves, preferably hermetically sealed within the receiver, to selectively direct hot gaseous or liquid refrigerant to selected points within the system, dependent upon the temperature/pressure conditions being experienced. Examples of a receiver with bypass valves are shown or described in U.S. Pat. Nos. 4,689,969; 4,718,245; and 4,815,298, all under common ownership with this patent application. While each of those previous patents addresses the general problem, there is still room for improvement in the context of a liquid chiller.

It would be highly desirable, therefore, to provide a liquid chiller having the features of rapid system start up in low ambient temperature; steady operation under varying load conditions; and effective use of the recovered heat. It is a specific object of this invention to provide such features. These, and other, advantages of this invention will become apparent in the remainder of this disclosure.

SUMMARY OF THE INVENTION

The refrigeration system of this invention includes a compressor, two condensers (one of which is referred to as the heat reclaim condenser, and the other of which is referred to as the remote condenser), a thermal expansion valve, an evaporator, and a receiver. Contained within the receiver is a set of bypass valves. Outside the receiver, and downstream from one of the bypass valves, is a chiller control valve.

The system of this invention addresses the problem of start up in low ambient temperature and steady operation under varying load conditions by way of the bypass valves contained within the receiver, in cooperation with the chiller control valve outside the receiver. The system of this invention permits the operator to direct the recovered heat to alternate locations by way of the two condensers, one of which is a remote condenser located away from the immediate surroundings of the system.

A brief description of the bypass valves, chiller control valve, and the remote condenser will be given here.

The Bypass Valves

In order to facilitate rapid system start up and steady operation during low or varying ambient temperature and refrigerant load conditions, it is highly desirable to provide two bypass valves. The system of this invention uses a receiver containing two bypass valves as taught in U.S. Pat. Nos. 4,718,245 and 4,815,298, each of which is specifically incorporated herein by reference. Such a receiver is commercially available from Van Steenburgh Engineering Laboratories, Inc., 1900 South Quince Street, Denver, Colo. 80231, under the brand name HEAD START. The two bypass valves are referred to in this disclosure as the condenser bypass valve and the vapor bypass valve.

Both bypass valves are of similar construction, and the following description applies to both the condenser bypass valve and the vapor bypass valve. The bypass valves are diaphragm-operated valves with opposing pressures above and below the diaphragm causing the diaphragm to open and close an attached valve stem and seat. A pressure dome and cylinder within the valve defines a chamber above and a chamber below the diaphragm.

The Condenser Bypass Valve. The dome side of the condenser bypass valve diaphragm is filled with an inert gas. The pressure of the inert gas on the dome side of the valve diaphragm is preset at the appropriate level (using well known pressure/temperature tables for a given refrigerant, and setting the pressure with regard to the desired process conditions) through a small diameter tube leading to the outside of the receiver. The chamber in the valve on the opposite side of the diaphragm is internally connected to the receiver, and sets a pressure against the diaphragm equal to the receiver pressure. A spring under the diaphragm or valve stem causes a bias towards the valve closed position. The dome side pressure is set to fully open the passage between the compressor outlet and the receiver, so as to direct hot refrigerant vapor into the receiver, when the receiver pressure is below the desired minimum pressure to be maintained in the receiver, say, 160 PSIG for R-22. The passage will remain open until the pressure in the receiver (plus the spring tension force of the bias spring in the condenser bypass valve) comes up to the preset pressure on the dome side of the condenser bypass valve.

The condenser bypass valve is actually a mixing valve which will allow hot gaseous refrigerant leaving the compressor to enter the receiver directly (without passing through the condenser), or will allow liquid refrigerant leaving the condenser to enter the receiver, or will modulate to intermediate positions to allow portions of both hot gas and liquid to enter the receiver depending on the receiver pressure. The purpose of this valve is to maintain a minimum pressure in the receiver. It does this by allowing hot gas to flow when the receiver pressure falls, and allowing liquid to flow when the pressure rises. The pressure in the receiver might fall under low ambient temperature conditions, or when there is insufficient refrigerant to back up refrigerant into the condenser to reduce the capacity of the condenser; opposite conditions would cause the pressure in the receiver to rise. Opening the condenser bypass valve to allow hot gas flow into the receiver when the receiver pressure is low facilitates system start up in low ambient temperature.

The Vapor Bypass Valve. The dome side of the vapor bypass valve diaphragm is filled with an inert gas. The pressure of the inert gas on the dome side of the valve diaphragm is preset at the appropriate level (using well known pressure/temperature tables for a given refrigerant, and setting the pressure with regard to the desired process conditions) through a small diameter tube leading to the outside of the receiver. The chamber in the vapor bypass valve on the opposite side of the diaphragm is connected through a small diameter tube to the line connecting the outlet of the vapor bypass valve to a point between the expansion valve and the evaporator (that is, it is connected to the bypass line that leads to a point downstream of the expansion valve, and sets a pressure against the diaphragm equal to the evaporator pressure). A spring under the diaphragm or valve stem causes a bias towards the valve closed position. The dome side pressure is set to open the vapor bypass valve when the evaporator pressure is low, or falling, and to fully open the valve when the pressure in the evaporator corresponds to a predetermined low temperature level, say, 32° F., for the refrigerant being used. Being partially opened as the evaporator pressure falls, and being fully opened when the evaporator pressure indicates that freezing is about to occur, the warm refrigerant vapor directed into the evaporator will raise the temperature in the evaporator to the desired level, and prevent freezing, under varying load conditions.

The vapor bypass valve can selectively cause warm refrigerant vapor from the receiver to bypass at least the thermal expansion valve by passing the refrigerant vapor to a point downstream of the thermal expansion valve. The vapor bypass valve is opened during low load conditions to raise the evaporator pressure and thereby prevent the evaporator temperature from going too low. The vapor bypass valve is very useful in raising the temperature of the evaporator by passing warm refrigerant vapor into the evaporator, bypassing the thermal expansion valve, to prevent fluid temperatures in the evaporator from falling too low, or perhaps even freezing. This facilitates steady operation under varying load conditions.

Both Bypass Valves. In order to maintain the gas in the domes of the two bypass valves at a relatively constant pressure, it is desirable to maintain the inert gas within the domes at a relatively constant temperature (or, at least, within a temperature range that is smaller than the outside ambient temperature range). This can be accomplished most satisfactorily by hermetically sealing the valves and locating them both within the receiver. However, the bypass valves as described in the preferred embodiment need not be located within the receiver in order to function.

The bypass valves respond directly to pressure changes of a predetermined magnitude and only indirectly to changes in temperature. For example, a drop in receiver temperature causes a drop in pressure on one side of the condenser bypass valve. This drop in pressure permits the preset pressure in the dome of the condenser bypass valve to overcome the force of the biasing spring and open the valve to permit flow of hot compressed gas into the receiver. Likewise, a drop in evaporator temperature causes a drop in pressure on one side of the vapor bypass valve, causing the preset pressure in the dome of the vapor bypass valve to overcome the force of its biasing spring and open the valve to permit flow of warm refrigerant vapor downstream of the thermal expansion valve and into the evaporator.

Through this cycle of operation, the condenser bypass valve tends to stabilize the pressure/temperature within the receiver under varying ambient temperature and load conditions; while the vapor bypass valve can rapidly heat the evaporator under low load conditions.

The Chiller Control Valve

The chiller control valve is a thermostat-controlled on/off solenoid valve which opens or closes the fluid line out of the vapor bypass valve, based on the temperature of the liquid being chilled as it leaves the evaporator. The thermostat probe is placed on the liquid line out of the evaporator and is electrically connected to the chiller solenoid control valve. When the liquid temperature is high, the chiller control valve is closed. But when the liquid temperature drops below the thermostat set point, the chiller control valve is open, permitting the flow of warm refrigerant vapor into the evaporator. This raises the temperature in the evaporator, raising the temperature of the liquid being cooled in the evaporator. The effect is to create a sensitive feed-back loop that causes a near-immediate correction of the temperature of the liquid being chilled in the evaporator.

In cooperation with the vapor bypass valve, the chiller control valve keeps the temperature variation of the liquid being chilled in the evaporator within a very narrow range, regardless of varying load conditions.

Because of the effect of the evaporator refrigerant output temperature on the thermal expansion valve (which, in turn, is influenced by the operation of the chiller control valve), it follows that the thermal expansion valve is being controlled, not only by the vapor bypass valve, but by the chiller control valve. That is to say, the thermal expansion valve is controlled by the temperature of the liquid exiting the evaporator as well as by the temperature of the refrigerant exiting the evaporator.

The Second Condenser

In a conventional refrigeration system of the vapor compression type, vaporized refrigerant is fed from the compressor to a condenser. In the condenser, the refrigerant is condensed to a liquid, and heat is dissipated from the refrigerant to a circulating coolant. The condenser may be located in the immediate vicinity of the rest of the system, where the recovered heat is absorbed by the ambient air surrounding the condenser, and the effect is to pump heat to the condenser location. If the condenser is removed from the immediate vicinity of the rest of the system, the heat pump works again to direct the recovered heat to the location of the condenser. In either case, the primary location of the heat pump is fixed by the site selected for the condenser's location.

In order to make efficient and effective use of the recovered heat, it is highly desirable to provide a second condenser to provide heat in an alternate location where it is needed. It is possible, by selecting the second condenser, to pump the heat to a second location.

The system of this invention employs two condensers, referred to as the remote condenser and the heat reclaim condenser. Of the two condensers, one is most likely outdoors, and the other is indoors with the rest of the system. A three-way valve in the compressor outlet line permits the vaporized refrigerant to be directed from the compressor to either of the two condensers (as well as permitting the condenser bypass valve to bypass both condensers).

By selecting the remote condenser, the system operator may pump the recovered heat to a remote location. Alternatively, by selecting the nonremote heat reclaim condenser, the operator may pump the recovered heat to any location where heat is needed within a reasonable distance from the chiller system. The remote condenser may be placed outside a building in which the rest of the system is installed. In summer operations, the remote condenser may be used to pump the recovered heat outdoors. In winter operation, the nonremote (heat reclaim) condenser may be used to retain the recovered heat indoors.

In the foregoing summary of the invention, it has been seen that the liquid chiller of this invention uses two bypass valves, in cooperation with a chiller control valve, to facilitate rapid system start up in low ambient and to maintain steady operation under varying loads. The liquid chiller of this invention also has a second condenser for effective use of the recovered heat. These, and other features, will be further explained in the detailed discussion which follows.

DETAILED DESCRIPTION OF THE INVENTION

Figure 1:
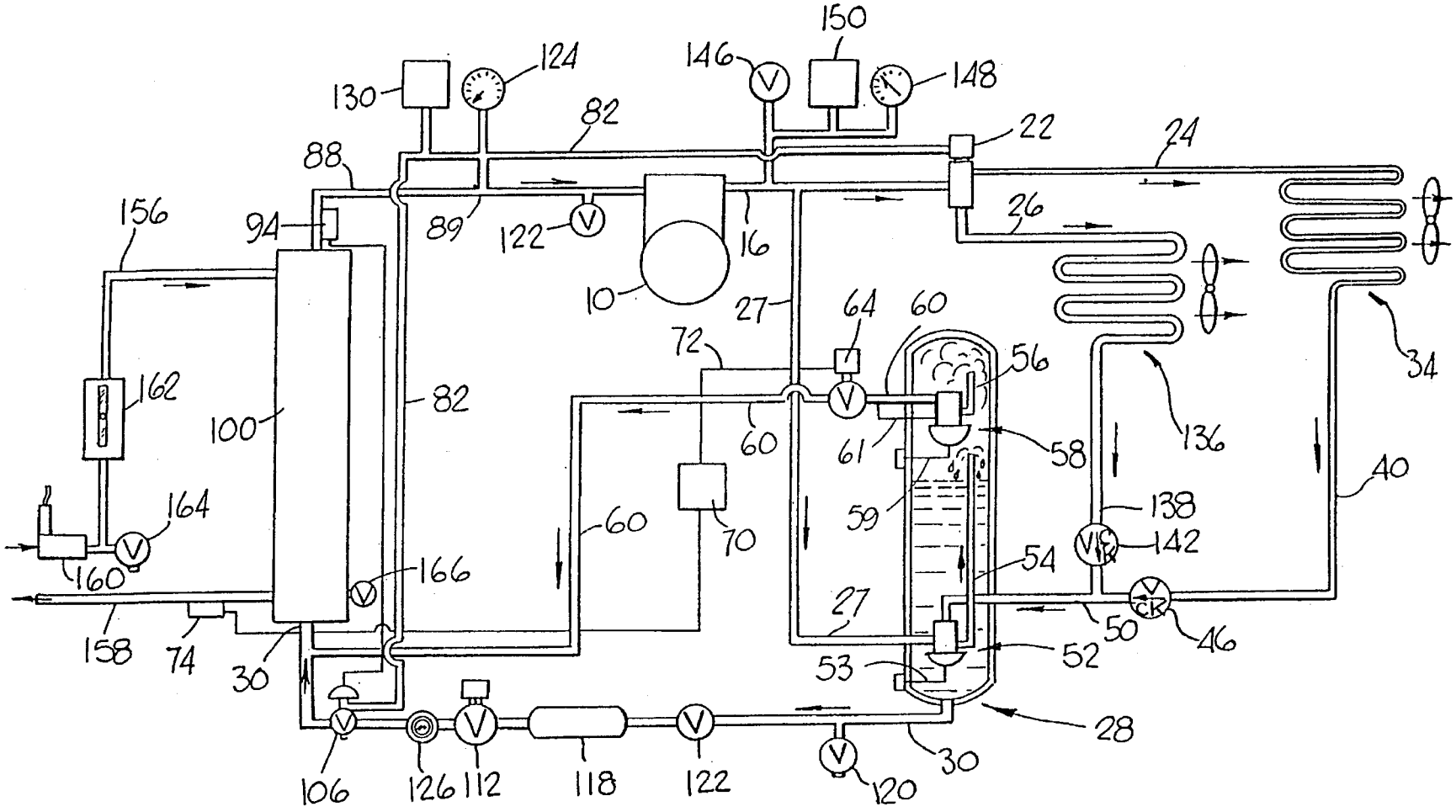
FIG. 1 is a schematic illustration of the refrigeration system of this invention.

As illustrated in FIG. 1, the refrigeration system of this invention includes, in overview, a compressor 10; a heat reclaim condenser 34 and a remote condenser 136; a refrigerant receiver 28 with condenser bypass valve 52 and vapor bypass valve 58; a chiller control valve 64; a thermal expansion valve 106; and an evaporator 100. The system also contains various other valves, controls, filter/driers, conduits and other components that will be further identified in the following discussion.

Refrigerant in the compressor 10 is compressed and then exits the compressor through a compressor discharge line, conduit 16. The discharge line leads to three-way valve 22. From the three-way valve, refrigerant is directed to either, but not both, condensers. From the three-way valve, conduit 24 leads to the heat reclaim condenser 34, and conduit 26 leads to the remote condenser 136.

Following the circuit from the three-way valve to the heat reclaim condenser 34, it can be seen that refrigerant is introduced into the heat reclaim condenser through conduit 24. The refrigerant exits the heat reclaim condenser through liquid line, conduit 40, with one-way flow controlled by check valves 46 and 142, and is directed into a receiver inlet pipe, conduit 50, which feeds into the refrigerant receiver 28.

Backing up to the three-way valve 22, and following the circuit from the three-way valve to the remote condenser 136, it can be seen that refrigerant is introduced from the three-way valve into the remote condenser through conduit 26. The refrigerant exits the remote condenser through a liquid line, conduit 138, with one-way flow controlled by check valves 142 and 46, and is directed into conduit 50 which feeds into the refrigerant receiver 28.

Refrigerant receiver 28 is a refrigerant receiver with condenser bypass valve 52 and vapor bypass valve 58. The receiver and bypass valves will be further discussed later in this specification, and are described in detail in U.S. Pat. Nos. 4,718,245 of Van Steenburgh (refrigeration system with bypass valves), and 4,815,298 of Van Steenburgh (refrigeration system with bypass valves), each of which is incorporated by reference herein. Such a receiver with bypass valves can be purchased from Van Steenburgh Engineering Laboratories as the HEAD START receiver, as already set forth in this specification.

Inlet pipe, conduit 50, feeds liquid refrigerant into condenser bypass valve 52. As will be discussed later, gaseous refrigerant may also be introduced into condenser bypass valve 52, through conduit 27. Refrigerant exits condenser bypass valve 52 through an outlet conduit 54. Liquid refrigerant passing through conduit 54 collects in the bottom of the receiver 28, from whence it is drawn off through conduit 30, while gaseous refrigerant passes through outlet 54 and rises to the top of the receiver, from whence it may be drawn off through conduit 56.

Following the circuit of liquid refrigerant from conduit 54 of the condenser bypass valve 52, it can be seen that liquid refrigerant collects in the bottom of receiver 28. The liquid refrigerant exits the receiver through conduit 30 and passes through filter/drier 118 and thermal expansion valve 106 and into evaporator 100. In a preferred embodiment, a pump down solenoid 112, for shutting down the system, is placed between filter/drier 118 and expansion valve 106. A drain valve 120 for removing refrigerant from the system, and a ball valve 122 for isolating the filter/drier when replacing it, may be placed in conduit 30 between the exit from receiver 28 and the filter/drier 118. A sight glass 126 may be placed in conduit 30 between the filter/drier 118 and the thermal expansion valve 106.

As will be discussed in more detail later, the evaporator is a shell and tube structure. Boiling (evaporating) refrigerant in tubes within the evaporator 100 is in heat exchange relation with, but not in fluid communication with, water (or other liquid) introduced into the evaporator through a water inlet line, conduit 156, and the cooled water (or other liquid) is drawn out of the evaporator through water outlet line, conduit 158. Warm gaseous refrigerant enters the evaporator through conduit 30, and cool gaseous refrigerant exits the evaporator through the compressor suction line, conduit 88, from whence the vaporized refrigerant is fed back into compressor 10. A bulb 94, placed on the compressor suction line, controls the opening and opening of thermal expansion valve 106 generally according to the temperature of the exiting refrigerant in conduit 88.

Backing up to outlet conduit 54 of the condenser bypass valve 52 within receiver 28, and following the circuit of gaseous refrigerant, it can be seen that the vapor rises to the top of the receiver. Gaseous refrigerant within the receiver may be drawn into vapor bypass valve 58 through conduit 56. The vapor exits vapor bypass valve 58 through the bypass line, conduit 60. Vapor that exits valve 58 through conduit 60 bypasses the expansion valve 106, and is fed into conduit 30 at a point down stream of the expansion valve and before the evaporator 100. Chiller control valve 64 is placed in bypass line 60, and also controls the flow of hot, gaseous refrigerant through the line. Chiller control valve 64 is opened and closed by an electric solenoid coil that is connected via electric line 72 to a thermostat 70. The thermostat takes its reading from probe 74 on the liquid outlet line 158, reacting to the temperature of the cooled liquid exiting evaporator 100.

Finally, returning once again to three-way valve 22 (following the circuit back out from compressor 10 through compressor discharge line 16) it can be seen that the hot gaseous refrigerant exiting the compressor may be directed to the heat reclaim condenser 34 or to the remote condenser 136 as previously discussed. In addition to those two paths, refrigerant exiting the compressor may also take a third path, bypassing the condensers. The third path comprises conduit 27. Conduit 27 is in fluid communication with compressor discharge line, conduit 16, and passes through an opening in receiver 28, feeding hot gaseous refrigerant into condenser bypass valve 52 within the receiver.

Additional controls and meters include:

An equalizer line 82 that runs from the thermal expansion valve 106 to the three-way valve 22, and taps into compressor suction line, conduit 88, at junction 89. The equalizer line serves to equalize the pressure to the suction line.

A low pressure control 130 and a low pressure gauge 124 in fluid communication with compressor suction line 88. The low pressure control operates as a pump-down switch to shut off the compressor when the suction pressure approaches zero. The low pressure gauge allows visual monitoring of the suction pressure in line 88 (a measure which can be converted to the saturation temperature within the evaporator).

A high pressure control 150, a high pressure gauge 148, and a discharge valve 146 in fluid communication with compressor discharge line 16. The high pressure control operates as a safety device to shut off the compressor when the pressure exceeds a maximum safe operating pressure. The high pressure gauge allows visual monitoring of the pressure in line 16 (a measure which can be converted to the saturation temperature within the compressor).

A water flow inlet switch 160, drain valve 164, and flow meter 162 in fluid communication with the water inlet line 156; and a drain valve 166 off the evaporator 100.

Figure 2:
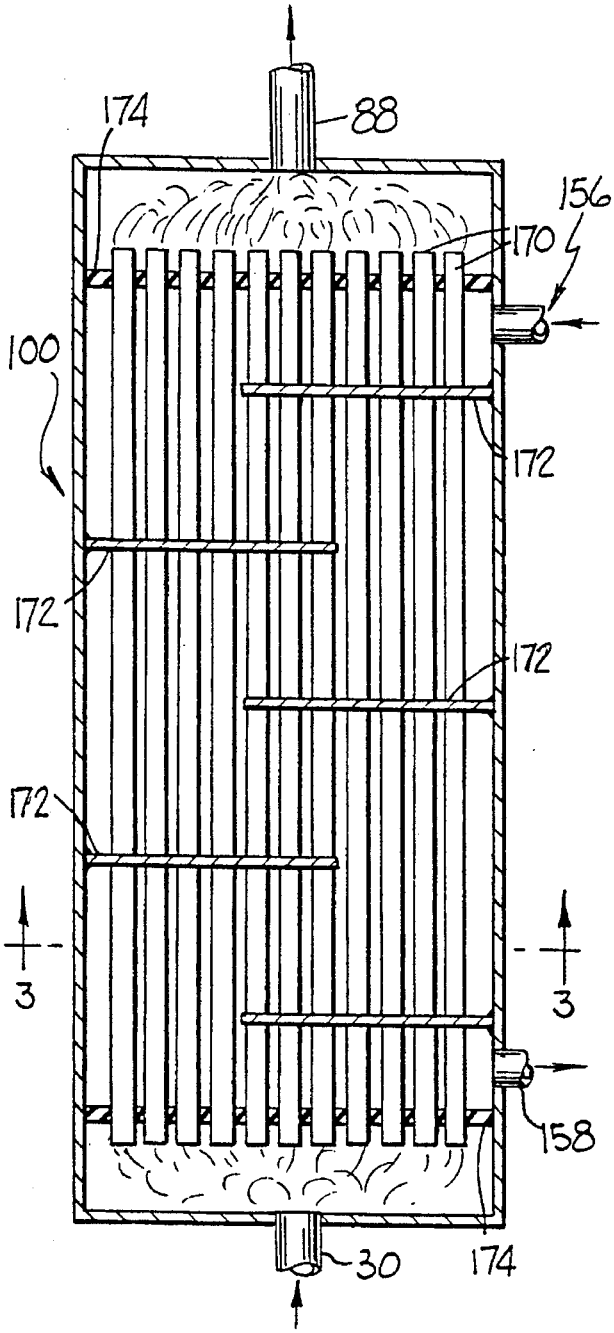
FIG. 2 is a side section view of a shell and tube evaporator heat exchanger used in an embodiment of this invention.

With reference to FIG. 2, the evaporator 100 can be understood to be a shell and tube structure. The liquid to be chilled, e.g., water, is fed into the evaporator through liquid inlet line 156 and is discharged from the evaporator through liquid outlet line 158. Boiling (evaporating) refrigerant is passed into the evaporator through conduit 30, where it is fed into tubes 170. After exiting the tubes, the refrigerant is returned to the compressor 10 through suction line 88. Within the evaporator, the water to be chilled is circulated around the the boiling (evaporating) refrigerant which is contained within the tubes 170 of the evaporator as the water passes through the evaporator. Baffles 172 attached to opposite interior walls of the evaporator create a zigzag flow of water within the evaporator to facilitate cooling of the water by establishing a longer path of water contact with the refrigerant tubes 170. Two tube sheets 174, one near the top, and the other near the bottom of the evaporator prevent the refrigerant and the water from coming into fluid communication with one another.

Figure 3:
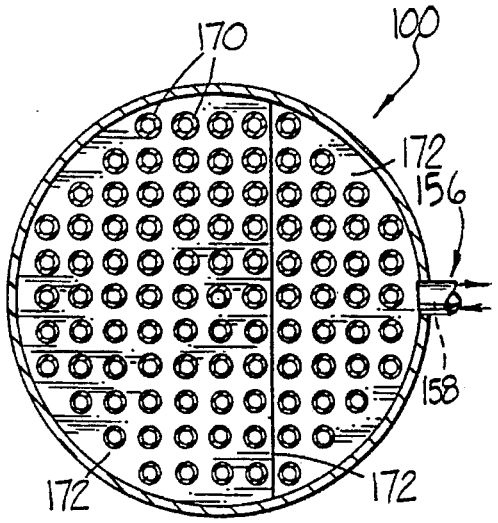
FIG. 3 is a cross-sectional view of the evaporator of FIG. 2.

FIG. 3 is a cross-sectional view of the evaporator of FIG. 2, taken along line 3—3. With reference to FIG. 3, the tubes 170 can be understood to be closely spaced within the evaporator.

Figure 4:
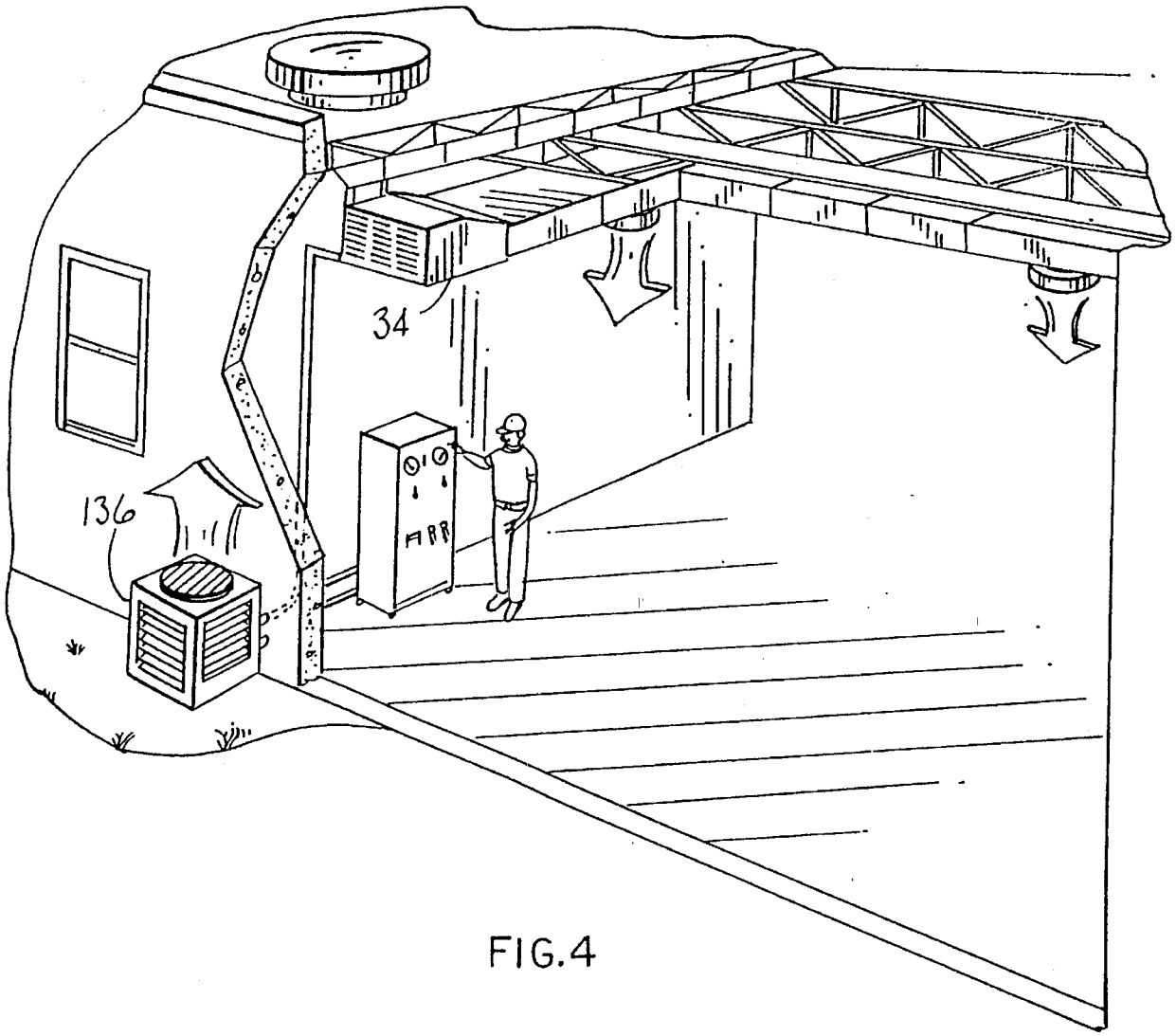
FIG. 4 is a pictorial view of the invention showing an installation making use of the remote condenser and heat reclaim condenser.

FIG. 4 is a pictorial view showing an installation of the refrigeration system of this invention within a building. The heat reclaim condenser 34 is within the building and the remote condenser 136 is outside of the building. This permits the recovered heat to be placed where the operator wants it. The heat may be pumped to the heat reclaim condenser, and directed indoors. Alternatively, the heat may be pumped to the remote condenser, and directed outdoors.

The operation of the refrigeration system of this invention is quite straightforward, and may be described as follows (giving special attention to the working of the two bypass valves, and the chiller control valve):

The Condenser Bypass Valve

The dome side of the valve diaphragm within condenser bypass valve 52 is filled with an inert gas. The pressure of the inert gas on the dome side of the valve diaphragm is preset at the appropriate level (using well known pressure/temperature tables for a given refrigerant, and setting the pressure with regard to the desired process conditions) through a small diameter tube 53 leading to the outside of the receiver. The chamber in the valve on the opposite side of the diaphragm is internally connected to the receiver 28 by a tube (not shown) drawn off the bypass valve outlet line 54, and sets a pressure against the diaphragm equal to the receiver pressure. A spring under the diaphragm or valve stem causes a bias towards the valve closed position. The dome side pressure is set to fully open the passage between the compressor and the receiver (via bypass inlet 27 and bypass outlet 54), so as to direct hot refrigerant vapor into the receiver 28 when the receiver pressure is below the desired minimum pressure to be maintained in the receiver, say, 160 PSIG for R-22. The passage will remain open until the pressure in the receiver (plus the spring tension force of the bias spring in the condenser bypass valve) comes up to the preset pressure on the dome side of the condenser bypass valve.

The condenser bypass valve is actually a mixing valve which will allow hot gaseous refrigerant leaving the compressor 10 to enter the receiver 28 directly (without passing through either the heat reclaim condenser 34 or the remote condenser 136) via bypass inlet 27; or will allow liquid refrigerant leaving the condensers to enter the receiver via bypass inlet 50; or will modulate to intermediate positions to allow portions of both hot gas and liquid to enter the receiver depending on the receiver pressure. The purpose of this valve is to maintain a minimum pressure in the receiver. It does this by allowing hot gas to flow when the receiver pressure falls, and allowing liquid to flow when the pressure rises. The pressure in the receiver might fall under low ambient temperature conditions, or when there is insufficient refrigerant to back up refrigerant into the condenser to reduce the capacity of the condenser; opposite conditions would cause the pressure in the receiver to rise.

Opening the condenser bypass valve 52 to allow hot gas flow into the receiver 28 through conduit 27 when the receiver pressure is low facilitates system start up in low ambient temperature. The condenser bypass valve 52 will be open in low ambient start up because the preset pressure in the dome chamber on one side of the diaphragm will be higher than the opposing receiver pressure on the other side of the diaphragm.

Accordingly, condenser bypass valve 52 can be seen to operate within the system of the liquid chiller of this invention as a three-way valve for supplying refrigerant to the receiver 28, either from the condensers 34, 136 or directly from the compressor 10 bypassing the condensers. When the pressure in the receiver 28 is relatively high (at normal operating temperature and pressure), the valve supplies liquid refrigerant to the receiver from one of the condensers. But, when the pressure in the receiver 28 is relatively low (at below-normal temperature and pressure), the valve shifts to provide for the flow of gaseous refrigerant to the receiver directly from the compressor, bypassing the condensers. The receiver pressure can drop, for example, when the ambient temperature surrounding the active condenser falls to a sufficiently low level, or when there is insufficient refrigerant to back up refrigerant into the condenser to reduce the capacity of the condenser.

When the pressure in the receiver is increased, the condenser bypass valve 52 no longer acts to bypass the condensers, and the refrigerant exiting the compressor 10 goes to three-way valve 22 for direction to one of the two condensers where it is condensed into a liquid. In an intermediate condition, a mixture of vapor and liquid refrigerant is fed into the receiver to maintain the desired temperature and pressure.

The Vapor Bypass Valve

The dome side of the valve diaphragm within vapor bypass valve 58 is filled with an inert gas. The pressure of the inert gas on the dome side of the valve diaphragm is preset at the appropriate level (using well known pressure/temperature tables for a given refrigerant, and setting the pressure with regard to the desired process conditions) through a small diameter tube 59 leading to the outside of the receiver. The chamber in the vapor bypass valve on the opposite side of the diaphragm is connected through a small diameter tube 61 to conduit 60, which connects the outlet of the vapor bypass valve 58 to a point in conduit 30 between the expansion valve 106 and the evaporator 100. When chiller control valve 64 is open, this sets a pressure against the vapor bypass valve diaphragm equal to the evaporator pressure. A spring under the diaphragm or valve stem causes a bias towards the valve closed position. The dome side pressure is preset to open the vapor bypass valve 58 when the pressure in the evaporator 100 is low, or falling, and to fully open the valve when the pressure in the evaporator corresponds to a predetermined low temperature level, say, 32° F., for the refrigerant being used. Being partially opened as the evaporator pressure falls, and being fully opened when the evaporator pressure indicates that freezing is about to occur, the warm refrigerant vapor directed into the evaporator at conduit 30 downstream of thermal expansion valve 106 will raise the temperature in the evaporator to the desired level, and prevent freezing, under varying load conditions.

Thus, when chiller control valve 64 is open, vapor bypass valve 58 can selectively cause warm refrigerant vapor from the receiver 28 to bypass at least the thermal expansion valve 106. The vapor bypass valve 58 is opened during low load conditions to raise the evaporator pressure and thereby prevent the evaporator temperature from going too low. The vapor bypass valve 58 is very useful in raising the temperature of the evaporator by passing warm refrigerant vapor into the evaporator, bypassing the thermal expansion valve 106, to prevent fluid temperatures in the evaporator from falling too low, or perhaps even freezing. This facilitates steady operation under varying load conditions.

Accordingly, it can be seen that the vapor bypass valve 58 is used to supply warm vapor from the compressor 10 via the receiver 28 to a point beyond the thermal expansion valve 106 during low load conditions (as, for example, when the refrigerant input to the evaporator 100 is at a lower than desired temperature), in order to maintain a nearly constant outlet water temperature.

The Chiller Control Valve

The chiller control valve 70 is a thermostat-controlled on/off solenoid valve which opens or closes the fluid line 60 out of the vapor bypass valve 58, based on the temperature of the liquid being chilled as it leaves the evaporator 100. The thermostat probe 74 is placed on the liquid line 158 out of the evaporator and is electrically connected to the chiller solenoid control valve. When the liquid temperature in line 158 is high, the chiller control valve 64 is closed. But when the liquid temperature in line 158 drops below the thermostat set point, the chiller control valve 64 is open, permitting the flow of warm refrigerant vapor into the evaporator 100. This raises the temperature in the evaporator, raising the temperature of the liquid being cooled in the evaporator. The effect is to create a sensitive feed-back loop that causes a near-immediate correction of the temperature of the liquid being chilled in the evaporator.

In cooperation with the vapor bypass valve 58, the chiller control valve 64 keeps the temperature variation of the liquid being chilled in the evaporator within a very narrow range, regardless of varying load conditions.

Because of the effect of the temperature of the refrigerant in suction line 88 on the thermal expansion valve 106, and because the temperature in suction line 88 is related to the temperature of the evaporator 100, which is, in turn, influenced by the operation of the chiller control valve 64 in response to the temperature of the liquid in water outlet line 158, it follows that the thermal expansion valve 106 is being controlled, not only by the vapor bypass valve 58, but by the chiller control valve 64. That is to say, the thermal expansion valve is controlled by the temperature of the liquid exiting the evaporator as well as by the temperature of the refrigerant exiting the evaporator.

In a conventional system, the thermal expansion valve 106 would typically be controlled according to the temperature of the refrigerant in the evaporator outlet conduit 88 by way of the thermal bulb 94 secured to the refrigerant outlet conduit and controlling the dome pressure above the diaphragm in thermal expansion valve 106. This conventional method of control would tend to open the thermal expansion valve and permit an increased flow rate of refrigerant into the evaporator as the temperature of the vaporized refrigerant leaving the evaporator increases.

In contrast to this conventional control, the system of this invention also controls the thermal expansion valve according to the temperature of the water in the evaporator water outlet conduit 158 by way of probe 74 secured to the water outlet and controlling the thermostat 70. Thermostat 70 opens the chiller control valve 64 when the water temperature goes low. This method of control opens the valve 64, and, when valve 64 is open, a pressure drop in line 60 and tube 61 will cause vapor bypass valve 58 to open, injecting warm refrigerant vapor into the evaporator. This provides near-immediate heat to the evaporator when the liquid being chilled goes below the desired temperature, and closely regulates the temperature of the chilled liquid.

In continued contrast to the conventional system, the system of this invention uses a condenser bypass valve 52 to pull hot vaporized refrigerant directly into the receiver 28 to rapidly increase the operating temperature and pressure within the receiver, or to pull liquid refrigerant in through the condenser, or to pull in a mix of gas and liquid in order to maintain a constant operating temperature and pressure.

And, as already noted, in further contrast to the conventional system, the system of this invention uses a vapor bypass valve 58 to pull hot vaporized refrigerant off the compressor (via condenser bypass valve 52, receiver 28, and conduit 60) to rapidly increase the load into the evaporator 100 when chiller control valve 64 is open.

Accordingly, it should be understood that, under certain pressure/temperature conditions, condenser bypass valve 52 directs the flow of gaseous refrigerant into the receiver 28 through conduit 27, bypassing both condensers 34 and 136. In addition, vapor bypass valve 58, in cooperation with chiller control valve 64, allows refrigerant at a high temperature and pressure to flow through conduit 60 and thence to conduit 30 downstream of the thermal expansion valve 106 and into the evaporator 100 when the temperature and pressure in the evaporator are below a predetermined level.

The Second Condenser

Finally, and as already mentioned, the heat reclaim condenser 34 is within the building and the remote condenser 136 is outside of the building. This permits the recovered heat to be placed where the operator wants it. The heat may be pumped to the heat reclaim condenser, and directed indoors. Alternatively, the heat may be pumped to the remote condenser, and directed outdoors. To operate the two condensers, the three-way valve 22 may be controlled manually by a switch, or automatically by a thermostat.

It can now be understood that the liquid chiller of this invention uses two bypass valves, in cooperation with a chiller control valve, to facilitate rapid system start up in low ambient and to maintain steady operation under varying loads. The liquid chiller of this invention also has a second condenser for effective use of the recovered heat.

This liquid chiller is well suited for cooling and controlling the temperature of a liquid, and may be used as the liquid chiller in such applications as electronic component production, photochemicals, plating, plastics, high speed drilling, machine tools, reclamation of volatile degreasing solvents, laser and x-ray cooling and other temperature sensitive operations.

What is claimed is:

1. A liquid chiller comprising:

(a) a compressor, a condenser, a receiver, a thermal expansion valve, and an evaporator;

(b) a first compressor-receiver pathway from the compressor to the receiver via the condenser, a second compressor-receiver pathway from the compressor to the receiver bypassing the condenser, and a condenser bypass valve controlled by pressure within the receiver for selectively directing the refrigerant to the first and second compressor-receiver pathways;

(c) a first receiver-evaporator pathway from the receiver to the evaporator via the thermal expansion valve, a second receiver-evaporator pathway from the receiver to the evaporator bypassing the thermal expansion valve, and a vapor bypass valve controlled by pressure within the evaporator for selectively directing the refrigerant to the first and second receiver-evaporator pathways; and (d) a chiller control valve in said second receiver-evaporator pathway, said chiller control valve controlled by the temperature of a liquid to be chilled.

2. The liquid chiller of claim 1, further comprising a second condenser in fluid communication with said first compressor-receiver pathway, and means for selectively directing a refrigerant from the compressor to the first and second condensers.

3. A liquid chiller comprising:

(a) a compressor;

(b) a first condenser and a second condenser;

(c) means for selectively directing a refrigerant from the compressor to either of the first and second condensers;

(d) a thermal expansion valve;

(e) means for directing the refrigerant from said first and second condensers to said thermal expansion valve;

(f) an evaporator having a refrigerant inlet to accept the refrigerant after it passes through said thermal expansion valve, a refrigerant outlet to pass the refrigerant back to the compressor, a liquid inlet for accepting a liquid to be chilled, and a liquid outlet for discharging said liquid, the liquid being in heat exchange relation to the refrigerant within said evaporator, wherein the thermal expansion valve is controlled by the temperature of the refrigerant in said refrigerant outlet, and by means responsive to the temperature of the liquid in said liquid outlet.

4. The liquid chiller of claim 3, further comprising a refrigerant receiver in fluid communication with said compressor, said communication being by way of:

(a) a first compressor-receiver pathway from the compressor to the receiver via the condensers, and (b) a second compressor-receiver pathway from the compressor to the receiver bypassing the condensers, the refrigerant receiver including a condenser bypass valve for selectively directing the refrigerant to the first and second compressor-receiver pathways.

5. The liquid chiller of claim 4, wherein said refrigerant receiver is in fluid communication with said evaporator, said communication being by way of:

(a) a first receiver-evaporator pathway from the receiver to the evaporator via the thermal expansion valve, and (b) a second receiver-evaporator pathway from the receiver to the evaporator bypassing the thermal expansion valve, the refrigerant receiver including a vapor bypass valve for selectively directing the refrigerant to the first and second receiver-evaporator pathways.

6. The liquid chiller of claim 5, wherein said means responsive to the temperature of the liquid in said liquid outlet is a chiller control valve in said second receiver-evaporator pathway, downstream of said vapor bypass valve.

7. The liquid chiller of claim 6, further comprising means for opening and closing said chiller control valve by the temperature of the liquid in said liquid outlet.

8. A method of chilling a liquid, comprising the steps of:

(a) selectively directing a refrigerant to a first compressor-receiver pathway from a compressor to a receiver via a condenser, and to a second compressor-receiver pathway from the compressor to the receiver bypassing the condenser, based on the pressure within the receiver;

(b) selectively directing the refrigerant to a first receiver-evaporator pathway from the receiver to an evaporator via a thermal expansion valve, and to a second receiver-evaporator pathway from the receiver to the evaporator bypassing the thermal expansion valve, based on the evaporator refrigerant pressure; and (c) controlling the flow of refrigerant in said second receiver-evaporator pathway, based on the temperature of a liquid being chilled as the liquid exits the evaporator.

9. The method of claim 8, further comprising the step of selectively directing the refrigerant to a second condenser at any time, the second condenser being in fluid communication with said first compressor-receiver pathway.

* * * * *